US006316921B1

(12) United States Patent
Noguchi et al.

(10) Patent No.: US 6,316,921 B1
(45) Date of Patent: Nov. 13, 2001

(54) POWER SUPPLY CONTROL SYSTEM

(75) Inventors: Mineo Noguchi; Bunsho Kuramori, both of Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/612,457

(22) Filed: Jul. 7, 2000

(30) Foreign Application Priority Data

Aug. 27, 1999 (JP) ..... 11-241563

(51) Int. Cl.[7] ..... G05F 1/10; G05F 1/40
(52) U.S. Cl. ..... 323/222; 323/285
(58) Field of Search ..... 323/222, 273, 323/276, 274, 275, 258, 312, 315, 317, 284, 285

(56) References Cited

U.S. PATENT DOCUMENTS 5,532,894 * 7/1996 Sweaton ..... 323/251
5,670,865 * 9/1997 Farwell ..... 323/285

* cited by examiner

*Primary Examiner*—Rajnikant B. Patel
(74) *Attorney, Agent, or Firm*—Rabin & Berdo, P.C.

(57) ABSTRACT

The aim of the present invention is to provide a power supply control system which enables an improvement in the response speed of the voltage sensor section to be achieved at a low level of power consumption. The present invention comprises: a voltage booster circuit for boosting voltage; a voltage sensor section which operates on the basis of voltage output from the voltage booster circuit; and a threshold value altering circuit which lowers a threshold value of the voltage sensor section when the voltage booster circuit is operating, and raises a threshold value of the voltage sensor section when the operation of the voltage booster circuit is halted.

18 Claims, 8 Drawing Sheets

FIG. 5 A NODE ①

FIG. 5 B NODE ②

FIG. 5 C NODE ④

FIG. 5 D NODE ③

POWER SUPPLY CONTROL SYSTEM

BACKGROUND OF THE INVENTION

1. Field of the Invention

The present invention relates to a power supply control system having a voltage sensor section.

2. Description of the Related Art

A voltage sensor section used in voltage control which is designed to operate at a low level of power consumption has the drawback of having a slow response speed. Therefore, in the conventional technology, it has been necessary to temporarily increase the current and quicken the response speed when high speed operation is required. As a result, it has been difficult to operate at a constantly low level of power consumption.

Accordingly, because of the operating delays in the voltage sensor section, excessive rises and falls in the voltage are generated during the startup of the circuit for causing the voltage to be abruptly increased or decreased in the voltage sensor section which operates at a constantly low level of power consumption.

SUMMARY OF THE INVENTION

It is an aim of the present invention to provide a power supply control system capable of achieving an improvement in the response speed of a voltage sensor section at low power consumption.

The aspects described below are proposed in order to achieve the above aim.

[1] The present invention is a power supply control system comprising: (a) a voltage booster circuit for boosting voltage; (b) a voltage sensor section which operates on the basis of voltage output from the voltage booster circuit; and (c) a threshold value altering circuit for lowering a threshold value of the voltage sensor section when a first level signal for operating the voltage booster circuit is output (namely, when the controlling voltage falls below the threshold value and the output from the voltage sensor section changes to "H"), and raising a threshold value of the voltage sensor section when a second level signal for halting the voltage booster circuit is output (namely, when the controlling voltage rises above the threshold value and the output from the voltage sensor section changes to "L").

[2] In the power supply control system according to [1] above, the voltage sensor section performs high sensitivity operations at a low level of power consumption used in a memory LSI.

[3] A power supply control system comprising: a voltage stepdown circuit for lowering voltage; a voltage sensor section which operates on the basis of voltage output from the voltage step-down circuit; and a threshold value altering circuit for raising a threshold value of the voltage sensor section when a first level signal for operating the voltage step-down circuit is output, and lowering a threshold value of the voltage sensor section when a second level signal for halting the voltage step-down circuit is output.

[4] In the power supply control system according to [3] above, the voltage sensor section performs high sensitivity operations at a low level of power consumption used in a memory LSI.

[5] In the power supply control system according to either [1] or [3] above, a clipping circuit is connected to the voltage sensor section.

[6] A power supply control system comprising: a regulating circuit for regulating voltage; a voltage sensor section which operates on the basis of voltage output from the regulating circuit; and a threshold value altering circuit for altering the threshold value of the voltage sensor section in accordance with a plurality of level signals output to operate the regulating circuit.

DESCRIPTION OF THE PREFERRED EMBODIMENTS

The embodiments of the present invention will now be explained in detail with reference to the drawings.

Figure 1:
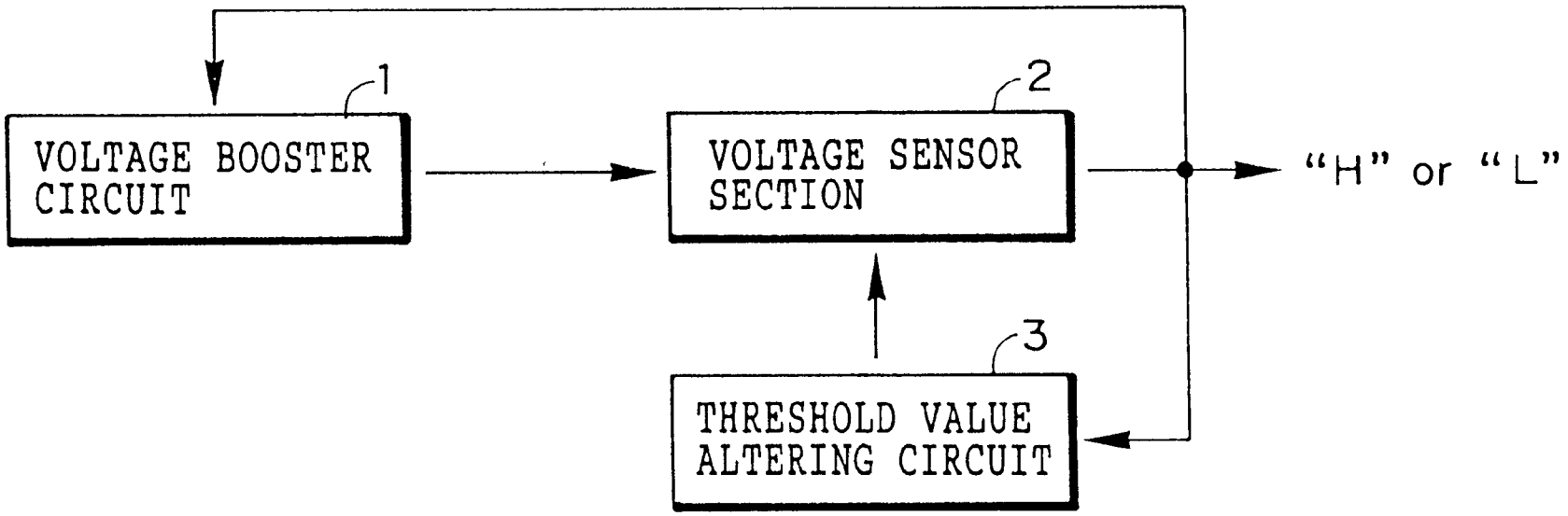
FIG. 1 is a schematic block diagram of a power supply control system showing the first example of the present invention.
Figure 2:
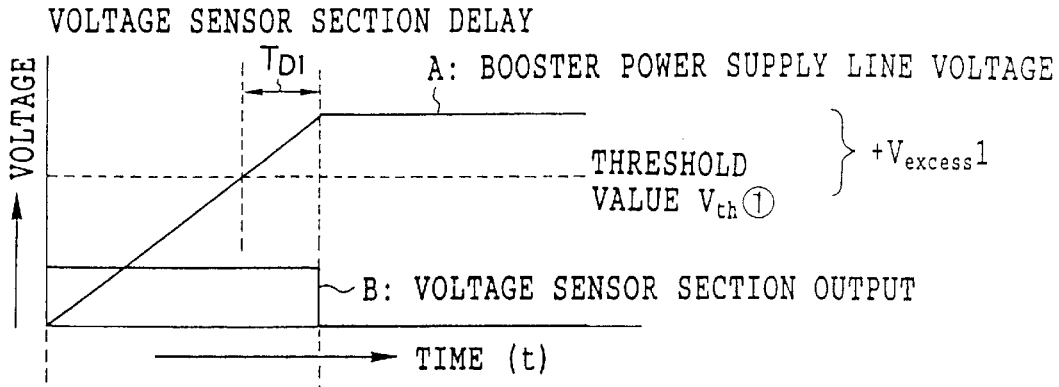
FIG. 2 is a view for reference of the schematic operation of the power supply control system showing the first example of the present invention when the threshold value alteration process is not performed.
Figure 3:
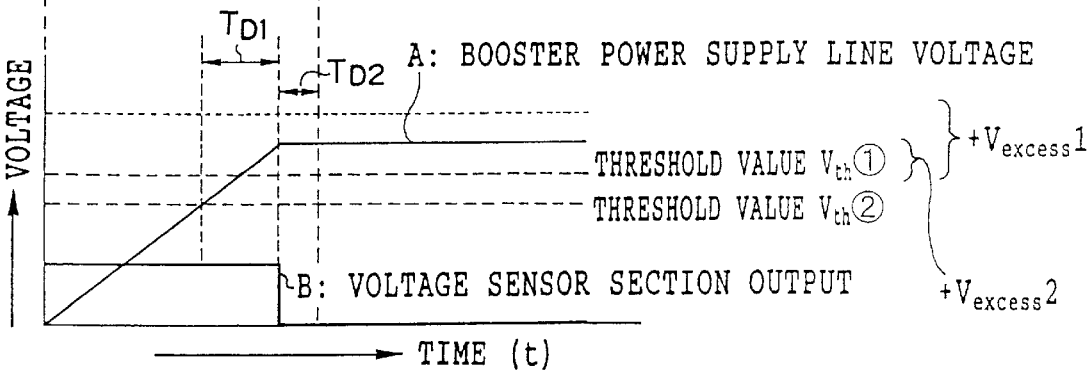
FIG. 3 is a view showing the schematic operation of the power supply control system showing the first example of the present invention when the threshold value alteration process is performed.

FIG. 1 is a schematic block diagram of a power supply control system showing the first example of the present invention. FIGS. 2 and 3 are diagrams schematically showing the operation of this power supply control system.

In FIG. 1, 1 denotes a voltage booster circuit, 2 denotes a voltage sensor section for controlling the voltage booster circuit, and 3 denotes a threshold value altering circuit of the voltage sensor section 2.

The function of the voltage booster circuit 1 is to raise the potential. When the potential is raised, the boosted voltage is controlled by the voltage sensor section 2. The power supply control system is structured so that the threshold value of the voltage sensor section 2 is able to be changed by the threshold value altering circuit 3 in accordance with whether the output from the voltage sensor section 2 is "H" or "L".

Next, the operation of the power supply control system is explained in outline with reference to FIGS. 2 and 3.

When the controlling voltage is lower than the threshold value $V_{th}$ ① of the voltage sensor section 2, the output from the voltage sensor section 2 is set to "H" and the operation of the voltage booster circuit 1 is started. At the same time, when it receives the output "H" from the voltage sensor section 2, the threshold value altering circuit 3 lowers the threshold value of the voltage sensor section 2 below the threshold value $V_{th}$① to become threshold value $V_{th}$②. Further, when the output voltage from the voltage booster circuit 1 is raised above the threshold value $V_{th}$② by the operation of the voltage booster circuit 1, the output from the voltage sensor section 2 changes to "L" and the operation of the voltage booster circuit 1 is stopped. At the same time, when it receives the output "L" from the voltage sensor section 2, the threshold value altering circuit 3 raises the threshold value of the voltage sensor section 2 to the original threshold value $V_{th}$① . In FIGS. 2 and 3, A indicates a booster power supply line voltage output from the voltage booster circuit 1 and input to the memory LSI. B indicates an output of the voltage sensor section.

If the power supply is controlled without altering the threshold value of the voltage sensor section, as in the conventional method, then the increase in the voltage is excessive by the amount $+V_{excess}$ 1 generated by the amount $T_{D1}$ of the delay of the voltage sensor section 2, as is shown in FIG. 2.

Therefore, in order to compensate for this delay, according to the present invention which uses the above described power supply control system, as is shown in FIG. 3, the threshold value of the voltage sensor section 2 is lowered to the threshold value $V_{th}$② when the voltage booster circuit 1 is operating, and the threshold value of the voltage sensor section 2 is raised to the threshold value $V_{th}$① when the voltage booster circuit 1 is not operating. In the event, this enables the amount of the delay of the voltage sensor section 2 to be shortened to $TD_2$ and the excess in the voltage increase can be reduced by a corresponding amount to $V_{excess}$2.

The structure of the power supply control system will be described below in detail using FIG. 4.

Figure 4:
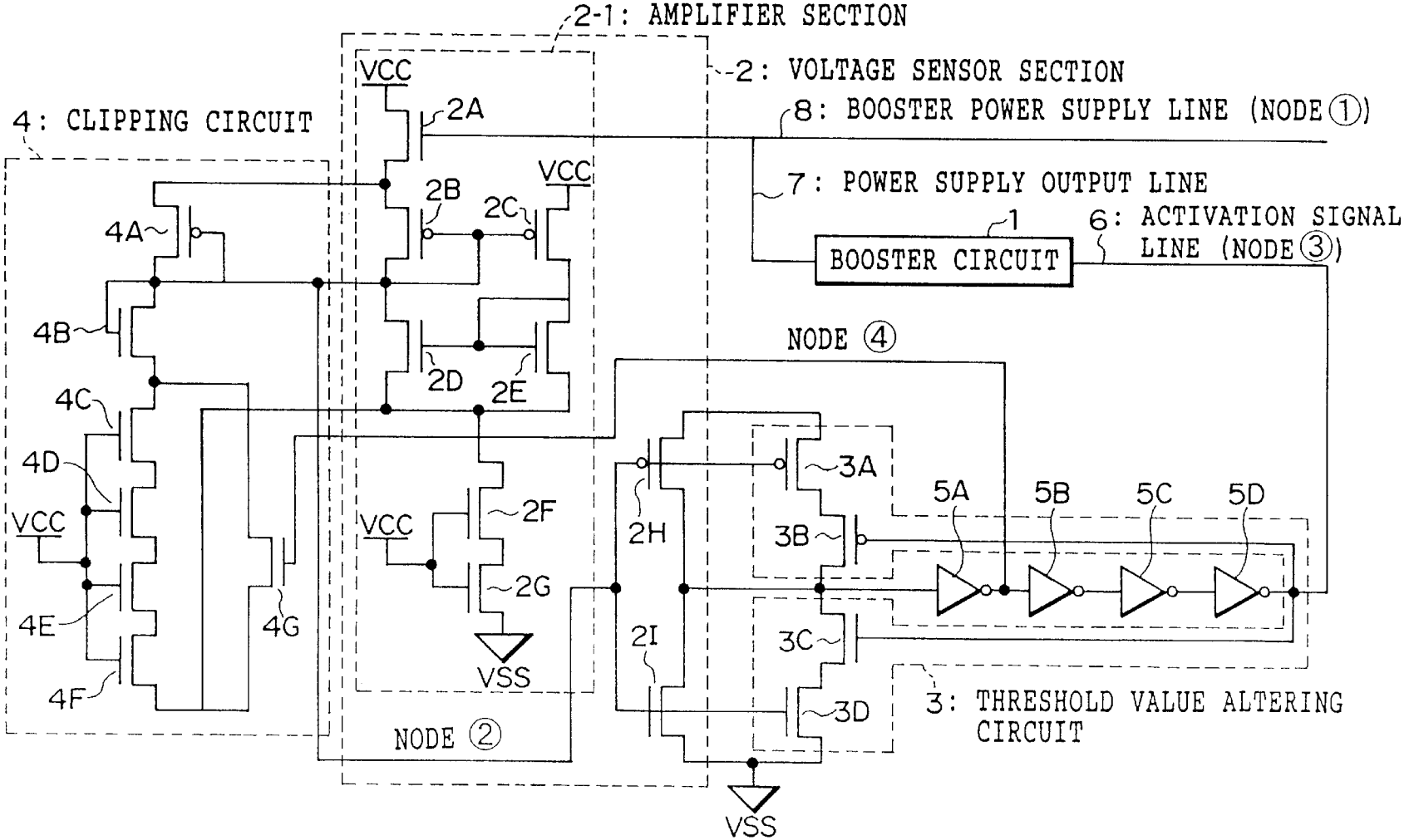
FIG. 4 is a view showing the specific structure of the power supply control system showing the first example of the present invention.

In FIG. 4, an activation signal line 6 is connected to the voltage booster circuit 1 from the threshold altering circuit 3. The output from the voltage booster circuit 1 is connected to the voltage sensor section 2 and a booster power supply line 8 via a power supply output line 7. The voltage sensor section 2 has an amplifier section 2-1. The amplifier section 2-1 is comprised of MOS integrated circuits 2A to 2G (MOS transistor group). The voltage sensor section 2 further has MOS integrated circuits 2H and 2I (CMOS transistors) whose gates are connected to node ② which is connected to a clipping circuit 4.

Furthermore, the threshold value altering circuit 3 is comprised of MOS integrated circuits 3A to 3D (MOS transistor group) and is connected to the voltage sensor section 2. The threshold value altering circuit 3 alters the threshold value of the voltage sensor section 2 in accordance with the state of the activation signal line (node ③).

A clipping circuit comprised of MOS integrated circuits 4A to 4G is further connected to the voltage sensor section 2. The clipping level of node ② is altered in accordance with the state of node ④.

Four inverters 5A to 5D are joined by cascade connection and are connected to the activation signal line 6 (node ③). The output signal of the inverter 5D also connects with the gates 3B and 3C of the MOS transistor 3B of the threshold value altering circuit 3.

Moreover, the output signal from the inverter 5A is connected to the gate of MOS transistor 4G of the clipping circuit 4.

The operation of the power supply control system shown in FIG. 4 is explained below in detail.

Figure 5:
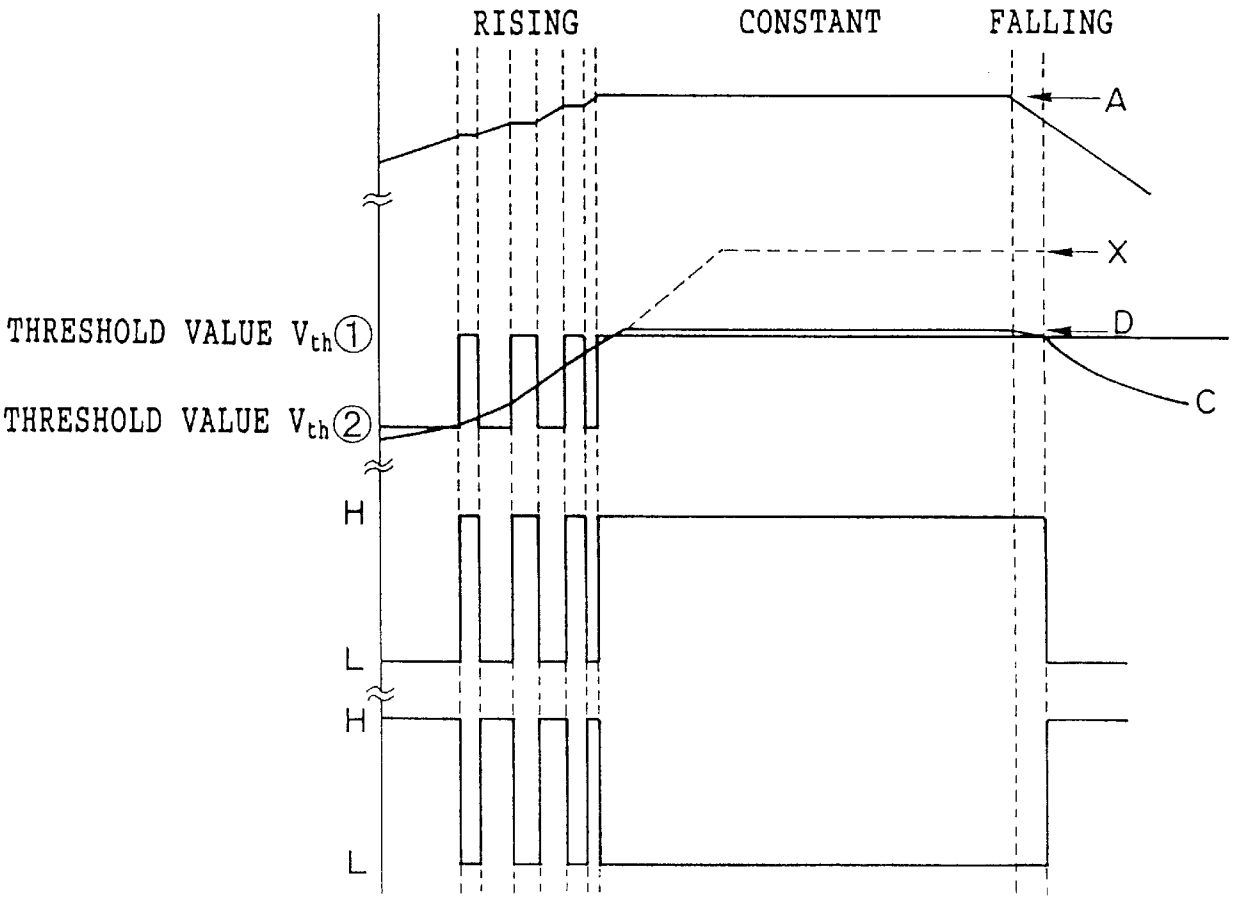
FIG. 5A is a wave form flow chart of node ① of the power supply control system of FIG. 4.
FIG. 5B is a wave form flow chart of node ② of the power supply control system of FIG. 4.
FIG. 5C is a wave form flow chart of node ④ of the power supply control system of FIG. 4.
FIG. 5D is a wave form flow chart of node ③ of the power supply control system of FIG. 4.
Figure 6:
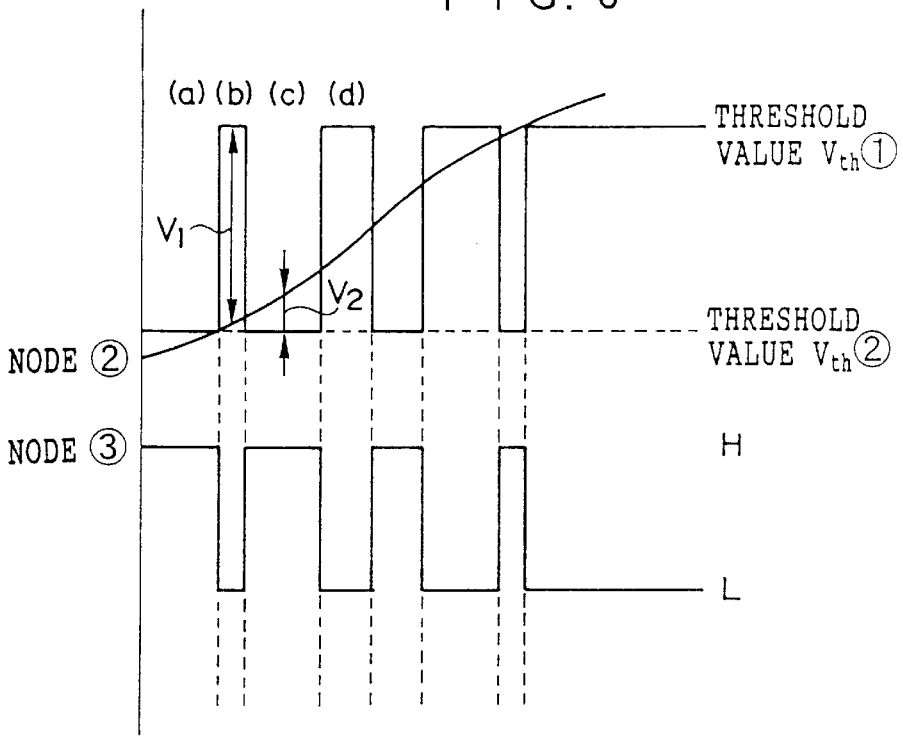
FIG. 6 is an explanatory diagram showing the details of the operation of nodes ② and ③ of the power supply control system of FIG. 4.
Figure 7:
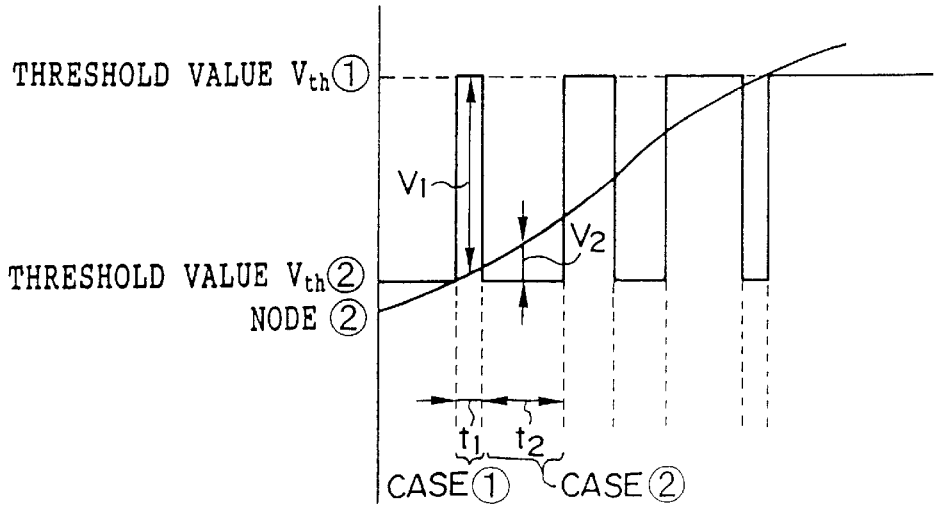
FIG. 7 is an explanatory diagram showing the first operational effect of the present invention.
Figure 8:
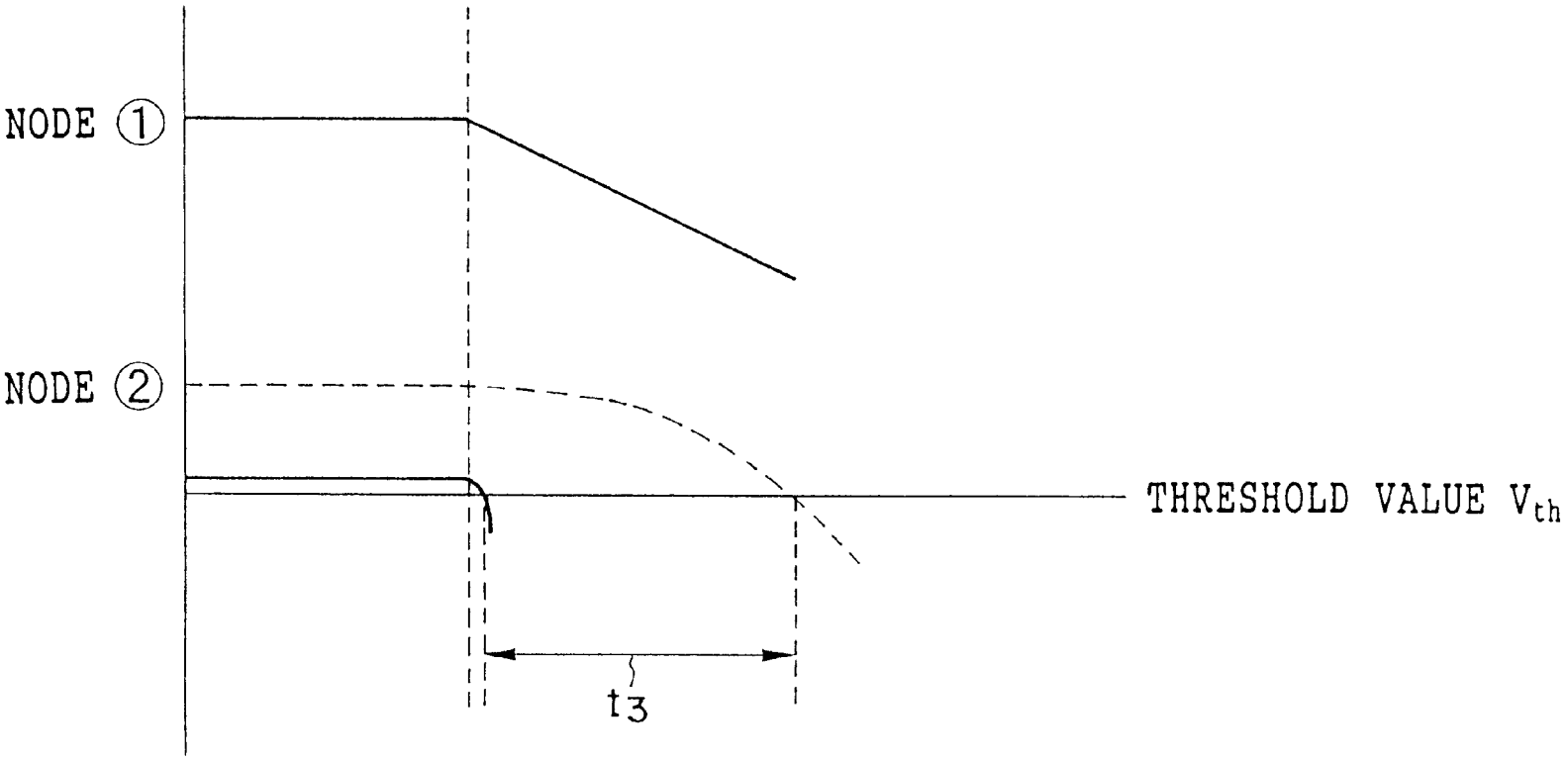
FIG. 8 is an explanatory diagram showing the second operational effect of the present invention.

FIG. 5 shows wave form timing flow charts for each section the power supply control system. FIG. 5A is a wave form diagram for node ①, FIG. 5B is a wave form diagram for node ②, FIG. 5C is a wave form diagram for node ④, and FIG. 5D is a wave form diagram for node ③. FIG. 6 is a diagram explaining the details of the operation of node ② and node ③, while FIG. 7 is an explanatory diagram of the first operational effect of the present invention, and FIG. 8 is an explanatory diagram of the second operational effect of the present invention.

The level of the voltage of node ① is displaced in the manner shown in FIG. 5A when the power supply line voltage A is rising, when the power supply line voltage A is constant, and when the power supply line voltage A is falling.

The voltage of node ②, as is shown in FIG. 5B, indicates a signal in which the potential variation of node ① has been enlarged by the amplifier section 2-1. Note that the broken line X represents the output voltage from the amplifier 2-1 without the clipping circuit 4, D represents the clipped output voltage from the amplifier 2-1 when the node ① is set to "H", while C represents the level of node ② when the power supply line voltage A begins to fall from that point.

The voltages of nodes ③ and ④, as is shown in FIGS. 5B, 5C and 5D indicate voltages determined by the relationship between node ② and the threshold value.

Each section will now be described in detail.

FIG. 6 shows that when node ③ (activation signal line 6) is set at "H", the threshold value is changed to a low threshold value (threshold value $V_{th}$②) by the threshold value altering circuit 3, and when node ③ is set at "L", the threshold value is changed to a high threshold value (threshold value $V_{th}$①) by the threshold value altering circuit 3.

(1) In step (a), the level of node ② is lower than the level of the threshold value $V_{th}$③, therefore node ③ is set at "H" and the voltage booster circuit 1 is operated.

(2) In step (b), the level of node ② has exceeded the level of the threshold value $V_{th}$②, therefore node ③ is set at "L" and the threshold value changes to threshold value $V_{th}$①. The output of the voltage sensor section 2 then changes to "L" and the operation of the voltage booster circuit 1 is halted. Moreover, if the potential difference $V_1$ between the threshold value $V_{th}$① and the potential of node ② is large, the potential variation of node ③ becomes more rapid. Therefore, the time taken for the routine to proceed from step (b) to step (c) is short. As a result, the quiescent time of the voltage booster circuit 1 is also shortened.

(3) In step (c), the level of node ② has fallen below the level of the threshold value $V_{th}$①. Therefore, node ③ changes back to "H", the threshold value changes back to the threshold value $V_{th}$②, and the voltage booster circuit 1 begins operating. Moreover, if the potential difference $V_2$ between the threshold value $V_{th}$① and the potential of node ② ) is small, the potential change of node ③ becomes slower. Therefore, the time taken for the routine to proceed from step (c) to step (d) is lengthened. As a result, the action time of the voltage booster circuit 1 is also lengthened.

By repeating the above operation, when node ② exceeds the threshold value $V_{th}$①, node ③ can maintain an "L" state and the voltage booster circuit 1 can also maintain its state of operational quiescence.

Moreover, in the above operation, when the potential difference between the threshold value $V_{th}$① and the potential of the node ② is large (in the same way as in the relationship between the set value of the booster power supply line 8 and node ①), the frequency at which the voltage booster circuit 1 is operated increases and the voltage increase is abrupt. However, when the potential difference is small, the frequency decreases and the voltage increase is gradual.

Next, the first effect of the operation of the present invention will be explained with reference to FIG. 7.

On the one hand, FIG. 7 shows that, when the potential difference $V_1$ between the potential of the node② and the threshold value in CASE①) is large, the CMOS circuit comprised of the MOS integrated circuits 2H, 2I, 3A~3D can more easily recognize that the potential difference $V_1$ is "H" level or "L" level. Therefore, the reaction speed of the CMOS circuit gets faster. As a result, the threshold value switches in the time $t_1$ (CASE①) due to the fast reaction speed of the CMOS circuit.

On the other hand, when the potential difference $V_2$ between the potential of the node②) and the threshold value in CASE②) is small, it is hard for the CMOS circuit comprised of the MOS integrated circuits 2H, 2I, 3A~3D to recognize that the potential difference $V_2$ is "H" level or "L" level. Therefore, the reaction speed of the CMOS circuit gets slower. As a result, the threshold value switches in the time $t_2$ (CASE ②) which is longer than the time $t_1$.

Because of the above characteristics, when node ① (booster power supply line 8) is lower than the target voltage by a sufficient amount, the length of time when node ③ (activation signal line 6) is set at "H" is long and at "L" is short. Therefore, the voltage can be boosted positively.

In contrast, when the target voltage is approached, the length of time that node ③ (activation signal line 6) is set at "L" lengthens and at "H" shortens. Therefore, the voltage boosting operation is slowed.

Namely, the threshold value altering circuit 3 has the characteristic that, the closer the booster power supply line 8 approaches to the target potential, the more the threshold value altering circuit 3 works towards slowing the voltage boosting operation and towards reducing voltage variation. The threshold value altering circuit also has the characteristic of absorbing delay in the amplifier 2-1 by altering the threshold value.

Next, the second effect of the operation of the present invention will be explained with reference to FIG. 8.

In FIG. 8, the node ① potential input to the amplifier 2-1 is amplified and output to node ②.

Conventionally, because the variation in potential is enlarged, in the constant section of FIG. 5, this enlargement of the potential is sufficient, as shown by the broken line X.

However, when the potential of node ① drops from this potential state, if the difference between the potential of node ① and the threshold value is large, the length of time until the output of an activation signal is long and the potential drops far below the target potential.

In order to prevent this problem in the conventional technology from arising, the upper limit of the amplification of the amplifier 2-1 is clipped so as to be in the vicinity of the threshold value (when node ④ is set at "H") [when node ③ (activation signal line 6) is set at "L"], and node ① is set so that, the instant it begins to fall, it drops below the threshold value. Subsequently, as is shown in FIG. 8, an increase in speed of the length of time $t_3$ is obtained and the operation of the sensor section 2 can be made even more sensitized.

Next, the second example of the present invention is explained.

Figure 9:
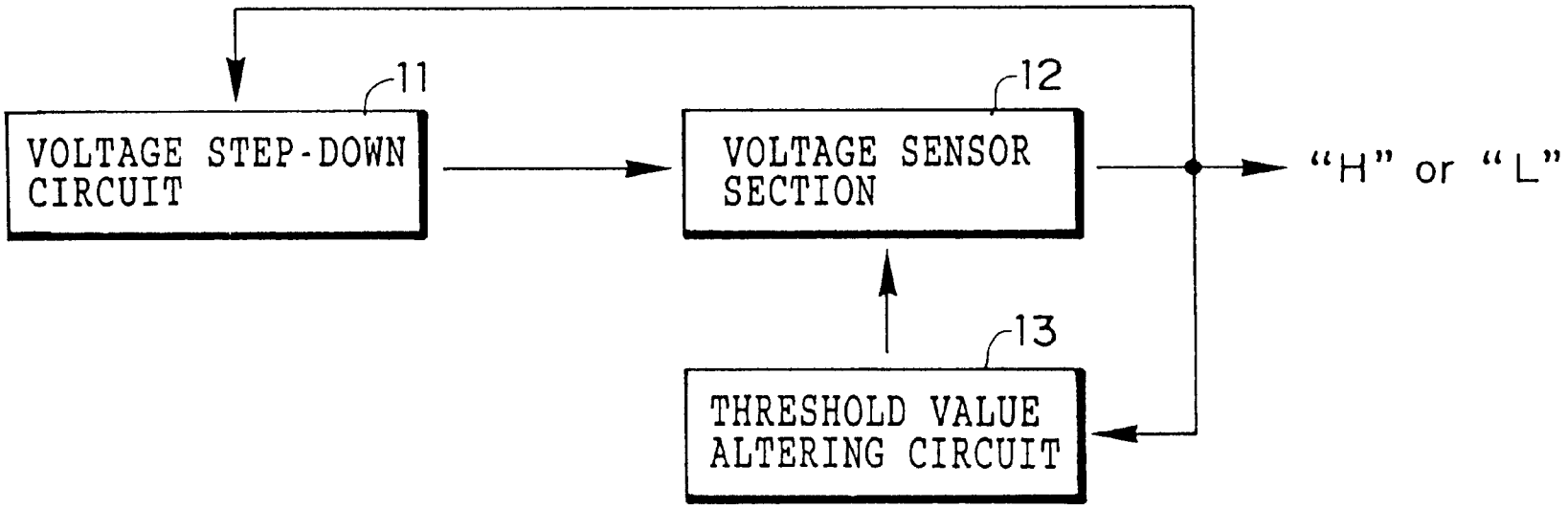
FIG. 9 is a schematic block diagram of a power supply control system showing the second example of the present invention.
Figure 10:
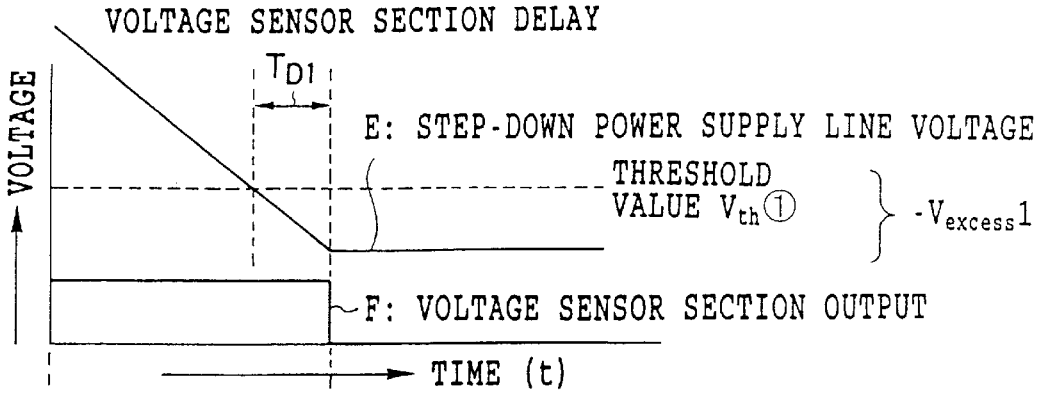
FIG. 10 is a view for reference of the schematic operation of the power supply control system showing the second example of the present invention when the threshold value alteration process is not performed.
Figure 11:
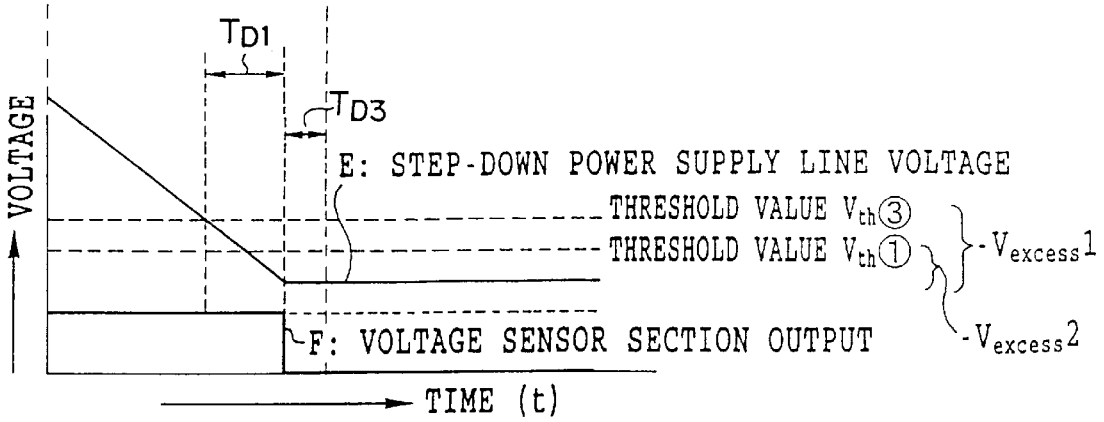
FIG. 11 is a view showing the schematic operation of the power supply control system showing the second example of the present invention when the threshold value alteration process is performed.

FIG. 9 is a schematic block diagram of a power supply control system showing the second example of the present invention. FIGS. 10 and 11 are views showing the schematic operation of this power supply control system.

In FIG. 9, 11 denotes a voltage step-down circuit, 12 denotes a voltage sensor section for controlling the voltage step-down circuit 11, and 13 denotes a threshold value altering circuit of the voltage sensor section 12.

The operation of this power supply control system will now be explained with reference to FIGS. 10 and 11.

When the controlling voltage is higher than the threshold value $V_{th}$① of the voltage sensor section 12, the output from the voltage sensor section 12 is set at "H" and the operation of the voltage stepdown circuit 11 is started. At the same time, when it receives the output "H" from the voltage sensor section 12, the threshold value altering circuit 13 raises the threshold value of the voltage sensor section 12 above the threshold value $V_{th}$① to become threshold value $V_{th}$③. Further, when the voltage is lowered to the threshold value $V_{th}$③, the output from the voltage sensor section 12 changes to "L" and the operation of the voltage step-down circuit 11 is stopped. At the same time, the threshold value of the voltage sensor section 12 is lowered to the original threshold value $V_{th}$①. In FIGS. 10 and 11, E indicates a step-down power supply line voltage output from the voltage step-down circuit and input to the memory LSI. F indicates an output of the voltage sensor section.

If the power supply is controlled without altering the threshold value of the voltage sensor section, as in the conventional method, then the decrease in the voltage is excessive by the amount $-V_{excess}$1 generated by the amount $T_{D1}$ of the delay of the voltage sensor section 12, as is shown in FIG. 10.

Therefore, in order to compensate for this delay, according to the present invention which uses the above described power supply control system, as is shown in FIG. 11, the threshold value of the voltage sensor section 12 is raised when the voltage step-down circuit 11 is operating, and the threshold value of the voltage sensor section 12 is lowered when the voltage step-down circuit 11 is not operating. This enables the amount of the delay of the voltage sensor section 12 to be shortened to $T_{D3}$ and the excess in the voltage decrease can be reduced by a corresponding amount to $V_{exces}$2.

Note that the present invention is not limited by the above examples and various modifications may be made based on the aims of the present invention and should not be removed from the scope of the present invention.

Note also that, in the description given above, two threshold values were used in the examples, however, the present invention is not limited to this and a plurality of threshold values (i.e. more than two) may be provided.

What is claimed is:

1. A power supply control system comprising:

(a) a regulating circuit for regulating voltage;

(b) a voltage sensor section, which operates based on voltage output from the regulating circuit; and (c) a threshold value altering circuit for altering the threshold value of the voltage sensor section in accordance with a level signal having multiple levels output to operate the regulating circuit, wherein the voltage sensor section is connected to the voltage regulating circuit, receives the voltage output from the regulating circuit, determines the correlation between said output voltage and the threshold value, and produces the level signal.

2. The power supply control system according to claim 1, wherein the regulating circuit produces output voltage, receives the level signal indicative of a correlation between said output voltage and the threshold value, and regulates said output voltage on the basis of the level signal.

3. A power supply control system comprising:

(a) a voltage booster circuit for boosting voltage;

(b) a voltage sensor section, which operates based on voltage output from the voltage booster circuit; and (c) a threshold value altering circuit for lowering a threshold value of the voltage sensor section when a first level signal for operating the voltage booster circuit is output, and raising a threshold value of the voltage sensor section when a second level signal for halting the voltage booster circuit is output.

4. The power supply control system according to claim 3, wherein the voltage booster circuit produces output voltage, receives the level signal indicative of a correlation between said output voltage and the threshold value, and boosts said output voltage based on the level signal.

5. The power supply control system according to claim 3, wherein the voltage sensor section is connected to the voltage booster circuit, receives voltage output from the booster circuit, determines the correlation between said output voltage and the threshold value, and produces the level signal.

6. The power supply control system according to claim 3, wherein the voltage sensor section performs high sensitivity operations at a low level of power consumption used in a memory LSI.

7. The power supply control system according to claim 3, wherein a clipping circuit is connected to the voltage sensor section.

8. The power supply control system according to claim 3, wherein a switching speed of a voltage booster circuit changes in accordance with a difference between a controlling voltage and a threshold value level.

9. The power supply control system according to claim 3, wherein the voltage sensor section comprises an amplifier.

10. The power supply control system according to claim 3, wherein an element in which the switching speed of the voltage booster circuit changes in accordance with a difference between a controlling voltage and a threshold value level is used in the threshold value altering circuit.

11. A power supply control system comprising:

(a) a voltage step-down circuit for lowering voltage;

(b) a voltage sensor section, which operates based on voltage output from the voltage step-down circuit; and (c) a threshold value altering circuit for raising a threshold value of the voltage sensor section when a first level signal for operating the voltage step-down circuit is output, and lowering a threshold value of the voltage sensor section when a second level signal for halting the voltage step-down circuit is output.

12. The power supply control system according to claim 11, wherein the voltage step-down circuit produces output voltage, receives the level signal indicative of a correlation between said output voltage and the threshold value, and lowers said output voltage based on the level signal.

13. The power supply control system according to claim, 11, wherein the voltage sensor section is connected to the voltage step-down circuit, receives voltage output from the step-down circuit, determines the correlation between said output voltage and the threshold value, and produces the level signal.

14. The power supply control system according to claim 11, wherein the voltage sensor section performs high sensitivity operations at a low level of power consumption used in a memory LSI.

15. The power supply control system according to claim 11, wherein a clipping circuit is connected to the voltage sensor section.

16. The power supply control system according to claim 11, wherein a switching speed of a voltage step-down circuit changes in accordance with a difference between a controlling voltage and a threshold value level.

17. The power supply control system according to claim 11, wherein the voltage sensor section comprises an amplifier.

18. The power supply control system according to claim 11, wherein an element in which the switching speed of the voltage step-down circuit changes in accordance with a difference between a controlling voltage and a threshold value level is used in the threshold value altering circuit.

* * * * *